United States Patent [19]

Hughes

[11] 4,241,877

[45] Dec. 30, 1980

[54] STABLE VORTEX GENERATING DEVICE

[75] Inventor: Nathaniel Hughes, Palm Springs, Calif.

[73] Assignee: Hughes Sciences Group, Inc., Palm Springs, Calif.

[21] Appl. No.: 951,621

[22] Filed: Oct. 16, 1978

Related U.S. Application Data

[63] Continuation-in-part of Ser. No. 886,289, Mar. 13, 1978, Pat. No. 4,189,101, which is a continuation-in-part of Ser. No. 785,838, Apr. 10, 1977, Pat. No. 4,109,862.

[51] Int. Cl.[3] ..... B05B 17/06

[52] U.S. Cl. ..... 239/405; 137/808; 239/463; 239/590.3; 261/DIG. 48; 261/DIG. 78

[58] Field of Search ..... 239/102, 304, 306, 307, 239/310, 311, 314, 317, 340, 346, 369, 372, 399, 403, 405, 406, 418, 432, 434, 463, 467, 474, 491, 589, 590.3, 590.5, 596; 137/808, 809, 811; 261/DIG. 48, DIG. 78

[56] References Cited

U.S. PATENT DOCUMENTS

| | | | |
|---|---|---|---|
| 970,382 | 9/1910 | Mummelthey | 239/590 X |
| 1,411,513 | 4/1922 | Pitt | 239/340 |
| 3,058,669 | 10/1962 | Drell | 239/434 X |
| 3,648,932 | 3/1972 | Ewald et al. | 239/337 |
| 4,109,862 | 8/1978 | Hughes | 239/102 |

*Primary Examiner*—Andres Kashnikow

*Attorney, Agent, or Firm*—Christie, Parker & Hale

[57] ABSTRACT

Exceptional atomization of liquids is achieved by combining shock wave formation and vortex generation in a gas stream. In a vortex generating device, a flow passage is aligned with a flow axis connected between a fluid inlet and a fluid outlet, and a plurality of tornado-like gas vortices are generated in the flow passage. In one embodiment, a restriction is formed in the fluid inlet, and a source of gas under sufficient pressure to cause sonic velocity at the restriction is connected to the inlet. In another embodiment, a restriction is formed in a downstream portion of a flow passage, and a pair of auxiliary flow passages connect an upstream portion of the flow passage to the restriction. In an embodiment, a fluid outlet has a concave semispherical surface opening into an ambient region. In another embodiment, a first annulus is formed in the flow passage by a rod, and a second annulus is formed in the flow passage by the rod and a reduction in cross-sectional area of the flow passage; a source of atomizing gas under pressure and a source of liquid under pressure to be atomized are both connected to the fluid inlet.

55 Claims, 10 Drawing Figures

STABLE VORTEX GENERATING DEVICE

CROSS REFERENCE TO RELATED APPLICATIONS

This application is a continuation-in-part of application Ser. No. 886,289, filed on Mar. 13, 1978, now U.S. Pat. No. 4,189,101 which is a continuation-in-part of application Ser. No. 785,838, filed on Apr. 10, 1977, which issued as U.S. Pat. No. 4,109,862, on Aug. 29, 1978. The disclosures of these related applications are incorporated fully herein by reference.

BACKGROUND OF THE INVENTION

This inventon relates to fluid vortex generation and, more particularly, to an improved vortex generating device useful as an atomizer and/or a sonic energy or flow transducer.

In one class of sonic energy transducer, sonic waves are generated by accelerating a gas to supersonic velocity in a nozzle. To achieve supersonic flow it has been necessary in the past to establish a large pressure drop from the inlet to the outlet of the nozzle. In order to produce sufficiently high energy levels for effective atomization and other purposes, prior art sonic energy transducers have used various measures such as a resonator beyond the outlet of the supersonic nozzle, as disclosed in my U.S. Pat. No. 3,230,924, which issued Jan. 25, 1966, or a sphere in the diverging section of the supersonic nozzle, as disclosed in my U.S. Pat. No. 3,806,029, which issued Apr. 23, 1974.

By means of stable, efficient vortex generation, the inventions disclosed in U.S. Pat. No. 4,109,862 and application Ser. No. 886,289 produce supersonic flow and higher energy levels with a lower pressure drop than prior art devices employing supersonic nozzles. Resonators or spheres are not required to produce high energy levels, although they may be advantageously employed to increase the level of energization under some circumstances.

SUMMARY OF THE INVENTION

The present invention is directed to improvements in a vortex generating device wherein a flow passage aligned with a flow axis is connected between a fluid inlet and a fluid outlet, and a plurality of tornado-like gas vortices are generated in the flow passage in an annular arrangement around the flow axis; the vortices also rotate about the flow axis.

An important feature of the invention is the combination of shock wave formation and vortex generation in a gas stream, which permits exceptional atomization of liquids.

According to one aspect of the invention, an inlet restriction is formed in the fluid inlet and a source of gas under sufficient pressure to cause sonic velocity at the restriction is connected to the inlet. Consequently, there exist in the flow passage sonic flow conditions that enhance the vortex action.

According to another aspect of the invention, a restriction is formed in a downstream portion of a main flow passage and a pair of auxiliary flow passages connect an upstream portion of the main flow passage to the restriction. The auxiliary flow passages compensate for changes in conditions in the device, thereby requiring fewer adjustments, generate further vortices, and produce a fan-shaped atomizing pattern when the device is used for liquid atomization.

According to another aspect of the invention, a fluid outlet has a concave semispherical surface opening into an ambient region. This semispherical section facilitates bidirectional, i.e., reciprocating, flow between the flow passage and the ambient region, which further enhances the vortex action. Atmospheric implosion of air causes an abrupt discontinuity of pressure and density which, along with similar effects in the rods, frustums, and other drag bodies and their related aerodynamic drag forces, creates high speed vortex zones and vortex vacuums. By the exposition of the vortex device discharge zones to efficient contact and/or availability of ambient caused gas velocity these phenomena are enhanced.

According to another aspect of the invention, a first annulus is formed in the flow passage by a rod in alignment with the flow passage, and a second annulus is formed in the flow passage by the rod and a reduction in cross-sectional area of the flow passage. A source of atomizing gas under pressure and a source of liquid under pressure to be atomized are both connected to the fluid inlet to cause the gas and the liquid to pass through the inlet together. The result is an effective atomizer at low gas pressure and/or small liquid flow rate.

BRIEF DESCRIPTION OF THE DRAWINGS

The features of specific embodiments of the best mode contemplated of carrying out the invention are illustrated in the drawings, in which.

DETAILED DESCRIPTION OF THE SPECIFIC EMBODIMENTS

Figure 1:
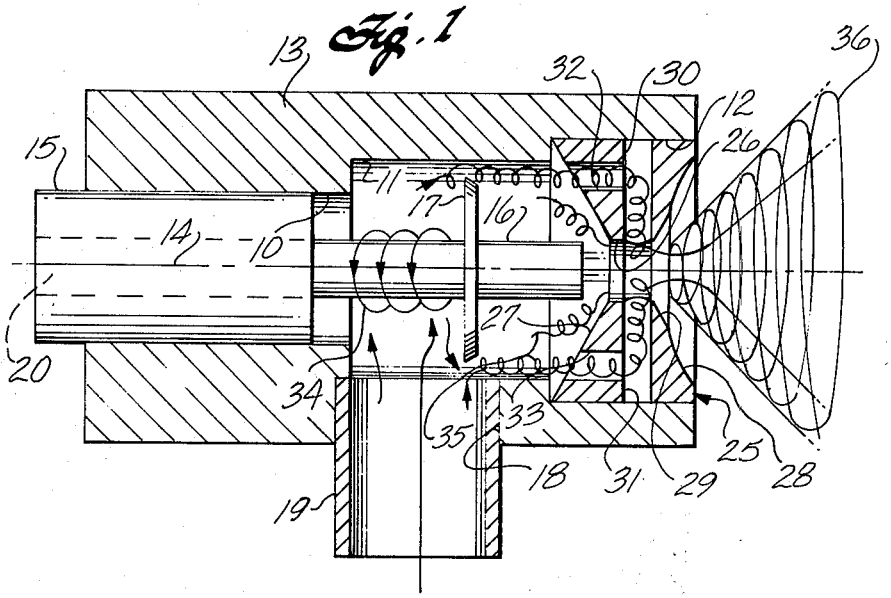
FIG. 1 is a side sectional view of one embodiment of a vortex generating device incorporating principles of the invention.

Like reference numerals are used to identify the same components in the different figures of the drawings. Only those components actually discussed in connection with a figure are identified by reference numerals, it being assumed the unidentified components are the same as those shown in previously discussed figures.

In FIG. 1, a cylindrical bore 10, a cylindrical counterbore 11, and a larger cylindrical counterbore 12 extend through a body member 13 from end to end in alignment with an axis 14. A cylindrical plug 15 fits in bore 10. A hollow rod 16, part of which fits in a bore 20 through plug 15, extends from one end of plug 15 completely through counterbore 11 and into counterbore 12 in alignment with axis 14. Rod 16 is secured to plug 15 by a force fit, welding, or the like. Once the position of plug 15 is set, it is fixed within bore 10 by a set screw, welding, or the like, so rod 16 cannot move. A truncated frustum 17 is fixedly mounted on rod 16 within counterbore 11 in alignment with axis 14. The base of frustum 17 faces toward bore 10. A bore 18 is formed in body member 13 in alignment with an inlet axis perpendicular to axis 14 so as to open into counterbore 11. A cylindrical inlet pipe section 19 fits into bore 18 to form a fluid inlet. A cylindrical insert 25 fits in counterbore 12. Insert 25 has in alignment with axis 14 a cylindrical bore 26, a concave conical surface 27 on the side of bore 26 opening toward rod 16, and a concave semispherical outlet surface 28 on the side of bore 26 opening away from rod 16. Bore 26 could be either larger or smaller in diameter than rod 16. Surface 28 forms a fluid outlet. A shallow concave conical surface 19 is formed where surface 28 joins the edge of bore 26. Rod 16 has an open end facing toward bore 26 in close proximity thereto. Radial bores 30 and 31 extend through insert 25 from its periphery to bore 26 into which they open from diametrically opposite directions. In other words, bores 30 and 31 are axially aligned with each other. Bores 32 and 33 extend through insert 25 parallel to axis 14 between surface 27 and bores 30 and 31, respectively.

Bore 11 and counterbore 12 together comprise a main flow passage from the fluid inlet to the fluid outlet; bore 11 comprises an upstream portion thereof; and counterbore 12 comprises a downstream portion thereof. Axis 14 comprises a flow axis, with which the flow passage is aligned. Bore 26 comprises a restriction in the downstream portion of the main flow passage. Bores 32 and 30 comprise one auxiliary flow passage from the upstream portion of the main flow passage to the restriction, and bores 33 and 31 comprise another auxiliary flow passage from the upstream portion of the main flow passage to the restriction. Frustum 17 comprises a bluff body. Surface 27 comprises a vortex collecting section for coupling the upstream portion of the main flow passage to the restriction, and surface 29 comprises a diverging section coupling the restriction to surface 28, which comprises a semispherical outlet section.

In operation, air or other atomizing gas under pressure is supplied to the fluid inlet. This gas impinges upon rod 16 and frustum 17 in the upstream portion of the main flow passage, spins around rod 16 as represented at 34, and forms a plurality of tornado-like vortices in a ring as the gas flows around the periphery of the bluff body toward the downstream portion of the main flow passage, as represented at 35. As described in application Ser. No. 886,289, the ring of vortices formed at the periphery of frustum 17 also rotates en masse around axis 14. The division of the flow of the vortex forming stream that takes place between the restriction and the auxiliary flow passages is a function of diameter of the restriction, rod position, and operating flow rates and pressures. The flow therethrough tends to be self adjusting. In many cases, the majority of the flow passes around the end of rod 16 and along the flow axis through the restriction. The remainder of the vortex forming gas flows through the auxiliary flow passages to combine with the majority at the center of the restriction. The components of the vortex forming gas containing vortices are thus focused at the center of the restriction in a manner analogous to the focusing of light by a lens. A single oblong vortex emanates from the outlet as represented at 36. A source of a liquid to be atomized such as, for example, paint, is connected to the hollow interior of rod 16. A subatmospheric pressure is generated somewhere in the vicinity of the restriction. In some cases, the liquid is not under pressure and the vacuum created draws the liquid out of the open end of rod 16 adjacent to bore 26 into the vortex forming gas. In other cases, the liquid is under pressure. As the gas moves through the described device, it atomizes the liquid and produces a finely atomized spray at the outlet in the oblong vortex 36.

The auxiliary passages perform three functions. First, they compensate for changes in operating conditions such as pressure and flow rate, thereby making adjustments unnecessary in many cases. Second, they enhance the vortex action in the device and thus its atomizing power. Third, the auxiliary passages form a fan-shaped spray at the outlet in the plane in which the axes of the auxiliary passages lie. To perform this function, or at least to form a symmetrical fan-shaped pattern and the self-compensating control function, a pair of diametrically opposite auxiliary passages, as shown, are preferred. Complex vortex forming, momentum balancing, and velocity and pressure exchange phenomena take place between the restriction and the two auxiliary passages. Rotational phenomena cannot be analyzed or understood by the laws of linear flow, i.e., Newtonian kinetics. Very little is known in the present state-of-the-art of vortex phenomena and interchange between thse phenomena and linear flow relationships. What is known in this invention is that a balanced pair of auxiliary passages related in area to the restriction and downstream of a transverse feed intersecting a rod will perform the functions of vortex forming and focusing, self compensation and vortex phenomenon enhancement (higher spin velocities, greater vacuum) resulting in superior atomization and/or higher sonic energy generation.

The diverging semispherical outlet facilitates bilateral, i.e., reciprocating, gas flow which, it is believed, is an integral part of the vortex formation process. It is accordingly believed that this process is substantially enhanced by the provision of such an outlet. Although not indispensable, the vortex collecting section, i.e., surface 27, and the diverging section, i.e., surface 29, are desirable as aids to obtain higher gas velocity out of the restriction.

All of the rules stated for the most efficient operation in application Ser. No. 886,289 are here applicable. To obtain a broad range of different flow characteristics, it is only necessary to change the diameter of the restriction, leaving the remaining dimensions the same. In a typical example, the device of FIG. 1 would have the following dimensions: diameter of bore 10—0.1875 of an inch; diameter of counterbore 11—0.312 of an inch; diameter of counterbore 12—0.375 of an inch; diameter of rod 16—0.068 of an inch; upstream, i.e., base, diameter of frustum 17—0.280 of an inch; thickness of frustum 17—0.032 of an inch; angle between edge surface of frustum 17 and axis 14—15°; length of bore 11—0.406 of an inch; length of counterbore 12—0.190 of an inch; protrustion of rod 16 into counterbore 12—0.040 of an inch; diameter of bore 26—0.070 of an inch; distance from upstream face of frustum 17 to end of rod 16—0.200 of an inch; inside diameter of section 19—0.312 of an inch; distance from inlet axis to junction of counterbores 11 and 12—0.250 of an inch; length of bore 26—0.090 of an inch; diameter of bores 30 through 33—0.070 of an inch; distance from the upstream end of hole 26 to the center of holes 30 and 31—0.045 of an inch; angle between conical surface 27 and axis 14—60°; length of surface 27 along axis 14—0.080 of an inch; angle between surface 29 and axis 14—60°; length of surface 29 along axis 14—0.014 of an inch; radius of curvature of surface 28—0.780 of an inch; and length of surface 28 along axis 14—0.027 of an inch. The pressure of the gas supplied to the inlet would be 15 psig.

Figure 2:
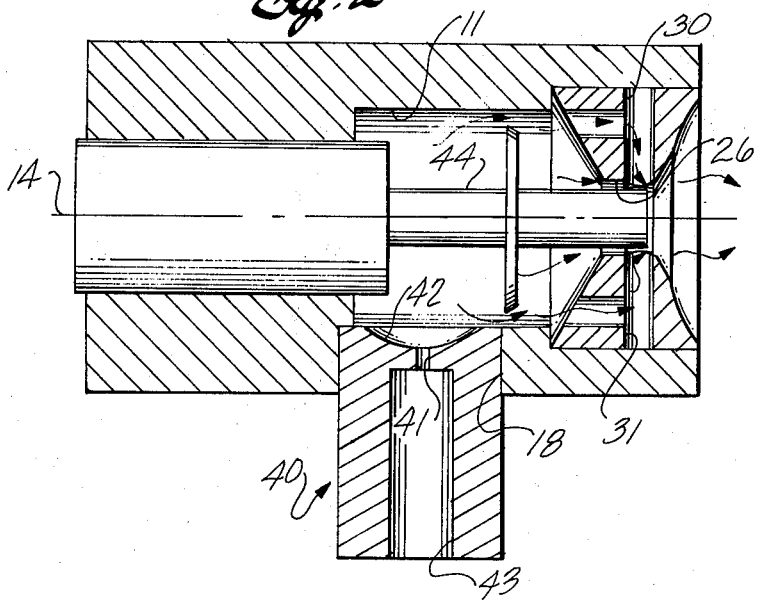
FIG. 2 is a side sectional view of a modification of the device of FIG. 1.

FIG. 2 shows a modification of the device of FIG. 1. Specifically, instead of inlet pipe section 19, a cylindrical inlet member 40 fits in bore 18. Member 40 has aligned with an inlet axis perpendicular to axis 14 a small bore 41, which functions as a restriction in inlet member 40, a concave semispherical surface 42 opening from one end of bore 41 into bore 11, and a counterbore 43 extending from the other end of bore 41. Bore 41 comprises a cylindrical upstream section, and surface 42 comprises a diverging downstream section. Gas and liquid under pressure are both supplied to the device through inlet member 40. Although in the device disclosed in FIG. 1, the ratio of the pressure of the gas supplied to the inlet to the ambient pressure could be either larger or smaller than the critical pressure ratio, when a restriction is formed in the inlet, as in FIG. 2, it is preferred that the supply gas pressure is selected so that the pressure ratio between the region of counterbore 43 and counterbore 11 is equal to or greater than the critical pressure ratio to cause gas flow through the restriction at sonic velocity. Any velocity increase, even if not to sonic velocity, at the gas inlet results in formation of a larger number of vortices, and thus greater vortex action in the final focused restriction, i.e., at base 26. If sonic velocity is achieved as discussed below, further energization through shock formation is attained. The combination of shock wave energies along with high speed vortex energy is particularly effective in the resultant atomization. The beneficial consequences of sonic flow conditions in the main flow passage are discussed below in connection with the embodiment of FIGS. 5A and 5B, and the embodiment of FIG. 6. Instead of rod 16 in FIG. 1, a rod 44 is provided that has a slightly smaller diameter than bore 26. Rod 44 extends into bore 26 partially across the region where bores 30 and 31 open into bore 26, i.e., its end lies partially in the path of the auxiliary passages. This modification produces a particularly effective fan-shaped spray and very great vortex action, by virtue of the transverse gas flow impingement against rod 44 from bores 30 and 31, when high gas pressure is available.

In a typical example, in addition to the dimensions given above in connection with FIG. 1, where applicable, the device of FIG. 2 would have the following dimensions: diameter of bores 26 and 41—0.070 of an inch; length of bore 41—0.040 of an inch; diameter of bore 43—0.110 of an inch; radius of curvature of surface 42—7/16 of an inch; length of surface 42 along the inlet axis—0.030 of an inch; diameter of rod 44—0.069 of an inch; protrusion of rod 44 into bore 26—0.060 of an inch. The pressure of the gas and liquid supplied to the inlet would be 20 psig.

Figure 3:
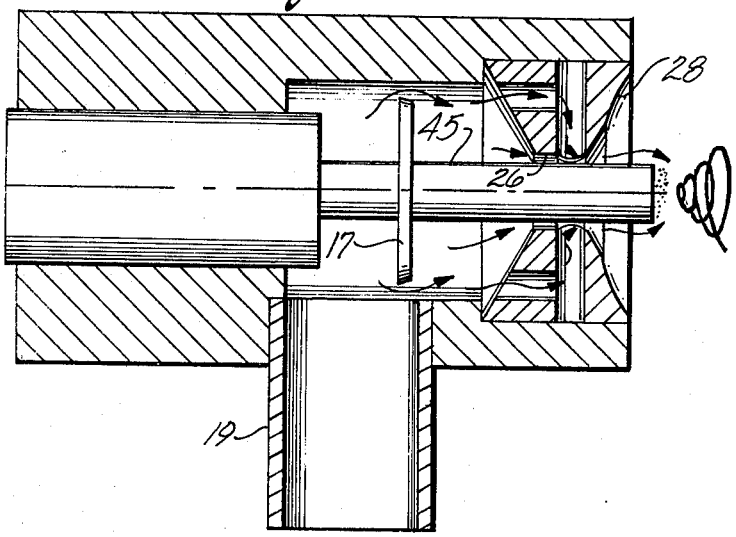
FIG. 3 is a side sectional view of another modification of the device of FIG. 1.

FIG. 3 is another modification of the device of FIG. 1. Instead of rod 16, a rod 45 having a smaller diameter than bore 26 is provided. Rod 45 extends completely through the flow passage to a point beyond the outlet of the device. Liquid to be atomized is fed to the gas at the end of rod 45, i.e., in mid air outside the device beyond the outlet, where good atomization takes place. It is noteworthy that a large subatmospheric pressure, e.g., 1 to 1½ psi, exists at the end of rod 45 beyond the outlet. In the most violent natural vortex having massive destructive power, namely, a tornado or hurricane, a pressure differential between the core and the outside of about 1 psig maximum exists. By contrast, the microcosmic process disclosed herein creates 1½ psig. Typically, in addition to the dimensions given above in connection with FIG. 1, where applicable, the device of FIG. 3 would have the following dimensions: diameter of rod 45—0.068 of an inch; protrusion of rod 45 beyond the plane of the periphery of surface 28—0.030 of an inch; distance from upstream face of frustum 17 to the end of rod 45—0.300 of an inch; and diameter of bore 26—0.078 of an inch. The vacuum generated in this embodiment is related to the weight flow of gas passing through this device in a relationship as the weight flow changes. Specifically, the change in vacuum generated externally is as the square of the weight flow change. This has application to flow sensing and transduction. The same applies to the vacuum weight flow relationship, as in the other devices described herein or in other copending applications.

Figure 4:
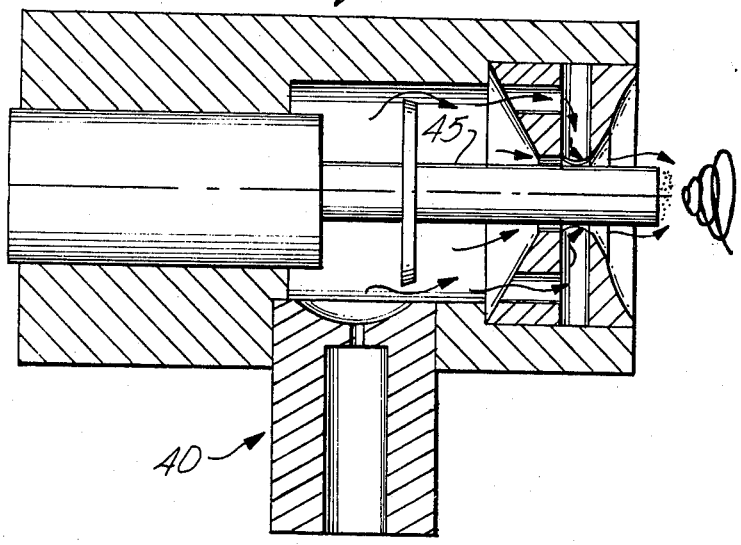
FIG. 4 is a side sectional view of still another modification of the device of FIG. 1.

The modification of FIG. 4 is identical to that of FIG. 3 except that inlet member 40 from FIG. 2 is substituted for inlet pipe section 19. This device is useful when a high pressure gas source is available, as in the device of FIG. 2. In the device of FIG. 4, gas and liquid can be fed into the inlet together as described below, in addition to the liquid fed through rod 45. Two or more fluids can be mutually atomized or even chemically reacted or homogenized in this manner.

Figure 5A:
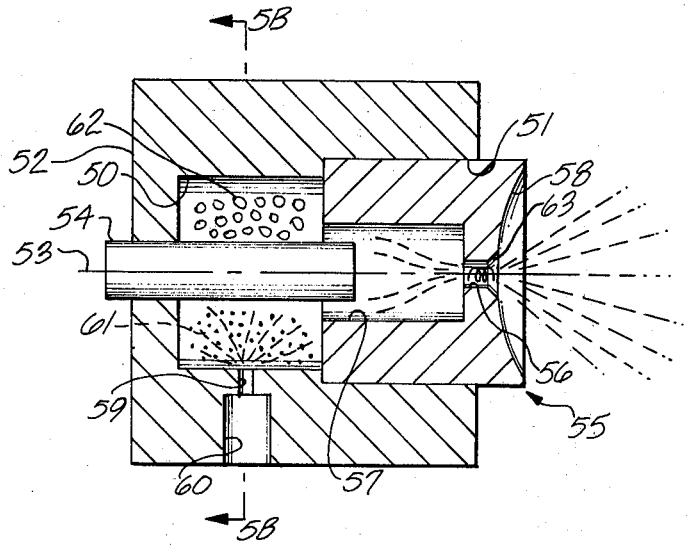
FIGS. 5A and 5B are side sectional and end sectional views, respectively, of another embodiment of a vortex generating device incorporating principles of the invention.
Figure 5B:
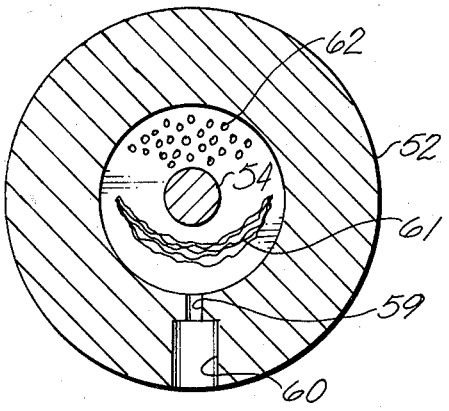

In FIGS. 5A and 5B, a body member 52 has a bore 50 and a counterbore 51 in alignment with an axis 53. A solid rod 54 is fixed at one end in a bore formed in member 52 and extends therefrom in alignment with axis 53 through bore 50 into counterbore 51. An insert 55 fits in counterbore 51. In alignment with axis 53 there are formed in insert 55 a bore 56, a counterbore 57 at the end of bore 56 facing toward the end of rod 54, and a concave semispherical outlet surface 58 at the end of bore 56 facing away from rod 54. A shallow concave conical surface 63 is formed where surface 58 joins the edge of bore 56. A bore 59 and a counterbore 60 aligned with an inlet axis perpendicular to axis 53 are formed in member 52 to open into bore 50.

Bore 59 and counterbore 60 comprises a fluid inlet. Further, bore 59 comprises a restriction in this inlet. Surface 58 comprises a semispherical diverging outlet that opens into the ambient atmosphere. Bore 50, bore 57, and bore 56 comprise a flow passage from the fluid inlet to the fluid outlet; bore 50 comprises an upstream portion thereof; and counterbore 57 along with bore 56 comprise a donwstream portion thereof. Counterbore 57 also provides an abrupt reduction in cross-sectional area of the flow passage. Axis 53 comprises a flow axis with which the flow passage is aligned. Bore 56 comprises a restriction in the downstream portion of the flow passage. Surface 63 comprises a diverging section between the restriction and the outlet. The side walls of bore 50 and rod 54 comprise one annulus in the flow passage. The side walls of counterbore 57 and rod 54 comprise a second annulus in the flow passage.

In this embodiment, the annulus formed by the side walls of counterbore 57 and rod 54 are equivalent to the annulus formed in FIG. 1 by frustum 17 with the exception that a subatmospheric pressure is not generated in the region of the annulus. There is only relevance to the subatmospheric pressure when the liquid to be atomized by cavitational phenomena or "cold boiling" has vapor entrained at atomospheric pressure, and the "cold boiling" potential depends on a subatmospheric ambient. If the fluid to be atomized, however, is pressurized (e.g., 5 psig or even 10 psig over the ambient pressure) than an introduction of the fluid into a reduced pressure region, even though it may be superambient, will result in considerable "cold boiling" and/or the resultant atomization. For this reason, the device will only atomize a liquid under pressure. A liquid under pressure can be atomized by the device when an atomizing gas under pressure and a liquid to be atomized under pressure are supplied together through the inlet to the device. Preferably, the ration of the gas pressure to the ambient pressure is greater than the critical pressure ratio.

In operation, the gas and liquid pass into the flow passage from the inlet together. As a result of the high gas pressure and the inlet restriction, the gas is sligthly supersonic as it enters the flow passage. The presence of rod 54 in front of the supersonic gas gives rise to a standing shockwave and generation of a very large number of vortices. The shockwave is represented at 61, and the vortices are represented at 62 in FIG. 5B. The potential energy, i.e., static pressure, of the gas supplied to the inlet is in effect partly converted to kinetic energy—first as an increase in linear gas velocity, then as shock waves, and finally as vortices in the flow passage. The vortices pass through the second annulus and combine as they flow through the outlet restriction. The liquid is partially atomized as it leaves bore 59, and becomes fully atomized as it leaves the semispherical diverging outlet in a vortical gas stream.

The supersonic conditions in the main flow passage enhance the vortex formation. The higher the velocity of the gas entering the inlet, the more gas vortices are generated. The higher the velocity of the gas entering the upstream portion of the main passage from the inlet restriction, the larger is the number of generated vortices and the greater is the atomizing power. For this reason, it is preferable to establish the critical pressure ratio across the inlet restriction because that results in sonic velocity flow conditions in the upstream portion of the main passage. However, a smaller increase in the number of vortices generated also results, vis-a-vis, a device without an inlet restriction, if the pressure ratio across the inlet restriction is less than the critical value.

In a typical example, the device of FIGS. 5A and 5B would have the following dimensions: diameter of bore 50—0.221 of an inch; length of bore 50—0.200 of an inch; diameter of counterbore 57—0.110 of an inch; length of counterbore 57—0.130 of an inch; diameter of bore 56—0.018 of an inch; length of bore 56—0.040 of an inch; radius of curvature of surface 58—7/16 of an inch; length of surface 58 along axis 53—0.030 of an inch; diameter of rod 54—0.070 of an inch; protrusion of rod 54 into counterbore 57—0.050 of an inch; diameter of bore 59—0.018 of an inch; length or bore 59—0.040 of an inch; angle between conical surface 63 and axis 53—60°; length of surface 63 along axis 14—0.014 of an inch; and diameter of counterbore 60—0.157 of an inch. Typical gas and liquid source pressures are 36 psig and 36 psig, respectively.

Figure 6:
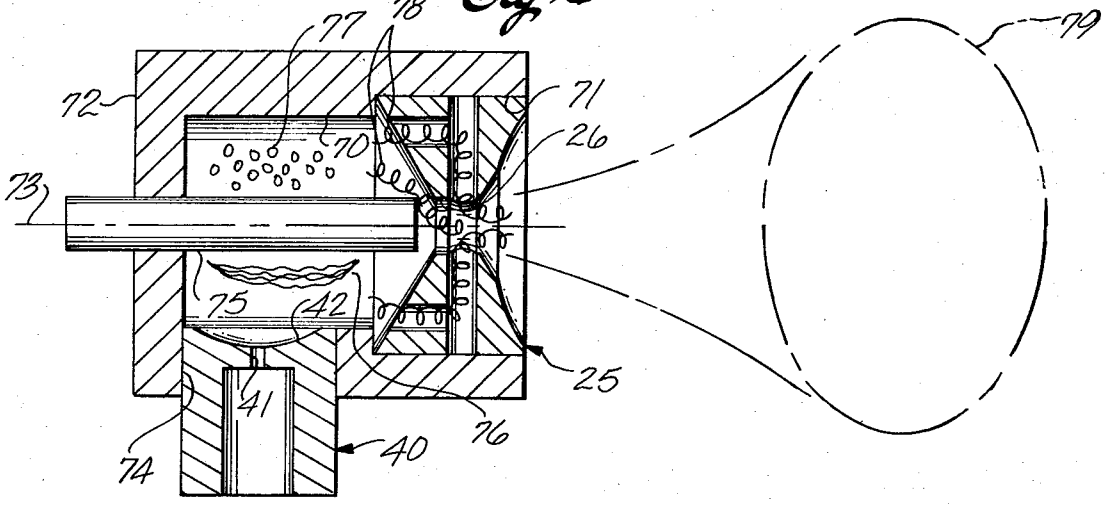
FIG. 6 is a side sectional view of still another embodiment of a vortex generating device incorporating principles of the invention.

In FIG. 6, a body member 72 has a bore 70 and a counterbore 71 in alignment with an axis 73. Insert 25 (FIG. 1) fits in counterbore 71. A bore 74 is formed in member 72 in alignment with an inlet axis perpendicular to axis 73. Cylindrical inlet member 40 (FIG. 2) fits in bore 74. A solid rod 75 is fixed at one end in a bore formed in member 72 and extends therefrom in alignment with axis 73 through bore 70 into counterbore 71.

In operation, an atomizing gas under pressure and a liquid to be atomized under pressure are supplied together through inlet member 40. The pressure ratio of the gas pressure to the pressure in bore 70 is preferably equal to or greater than the critical pressure ratio, so the gas entering bore 70 is traveling at a supersonic velocity. The presence of semispherical surface 42 permits a higher supersonic velocity to be attained than in the embodiments of FIGS. 5A and 5B. As represented at 76, the presence of rod 75 in the path of the supersonic gas gives rise to a standing shockwave on the side of rod 75 facing toward inlet member 40. As represented at 77, a plurality of vortices are formed in the gas on the side of rod 75 facing away from inlet member 40. The vortex forming gas with the entrained partially atomized liquid flows from bore 70 through the auxiliary passages, the main passage, and the restriction in insert 25 as represented at 78 to the outlet of the device where the liquid is completely atomized. As previously described in connection with FIG. 1, the auxiliary passages formed in insert 25 compensate for changes in conditions and form a fan-shaped spray pattern of atomized liquid and gas at the outlet of the device, represented at 79. The semispherical outlet section of insert 25 facilitates reciprocating gas travel. It should be noted that although no frustum is provided as in FIGS. 1 through 4, or no cylindrical reduction in cross section of the flow passage is provided as in FIGS. 5A and 5B, good atomization takes place so long as sufficiently high gas and liquid pressure are available. The absence of a frustum would not permit really effective atomization were it not for the highly effective vortex and shock generation due to the inlet restriction (caused by transverse gas feed against the rod) and the attendant synergy between such shockwave energies and vortices as previously noted. Further, the outlet restriction with auxiliary flow passages and transverse rod dynamics creates a further effective vortex forming and amplification mechanism not unlike the bluff bodies (frustums, rods, etc.) and concentric circular annuli.

Typically, in addition to the dimensions given above for insert 25 and inlet member 40, the device of FIG. 6 would have the following dimensions: diameter of bores 41 and 26—0.041 of an inch; dimeter of bore 70—0.312 of an inch; length of bore 70—0.312 of an inch; diameter of rod 75—0.070 of an inch; and protrusion of rod 75 into the conical section of insert 25—0.040 of an inch. Typical gas and liquid source pressures are 15 psig, and 15 psig, respectively.

Insert 25 and insert 55 function in a fashion analogous to a lens in that they focus the vortex containing gas at the outlet restriction; both the auxiliary passages, where used, and the collecting section of these inserts contribute to the focusing function.

Figure 7:
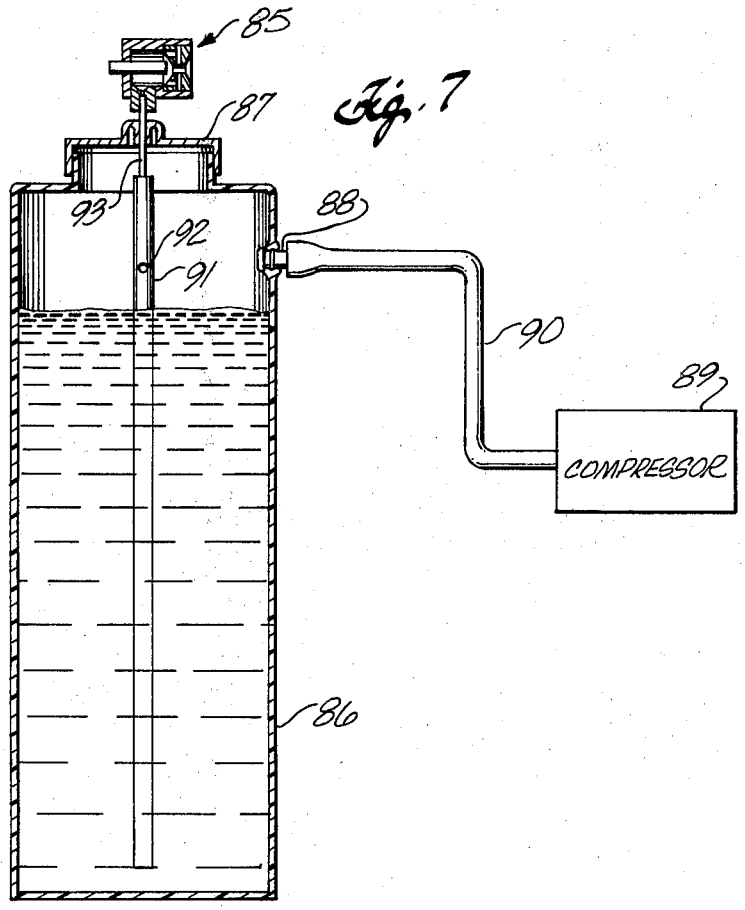
FIG. 7 is a side sectional view of an aerosol spraying system incorporating the device of FIG. 6.

In FIG. 7, the device of FIG. 6 which is designated 85, is employed in a complete aerosol system. A flexible, molded plastic bottle 86 has an airtight lid 87 and an air inlet 88. Air under pressure from a compressor 89 is supplied to inlet 88 through a flexible hose 90. Bottle 86 is filled with a liquid to be atomized by opening lid 87 and pouring the liquid in. A tube 91 that is open at both ends and has a vapor tap or gas feed hole 92 above the liquid level, is connected at its upper end to the inlet of device 85 by a conduit 93 that extends through lid 87. Air under pressure is supplied to the region above the liquid in bottle 86 by compressor 89, thereby pressurizing the liquid as well. Air passes to device 85 through hole 92, and liquid passes to device 85 through the open bottom of tube 91. Compressor 89 could have a regulator (not shown) to control its pressure, and a conventional aerosol ON/OFF valve (not shown) could be provided between tube 91 and conduit 93 to control the flow of liquid to be atomized through device 85. Uniquely, because of the novel atomizer nozzle employed, air as a power source is particularly effective. Further, the device is not like commercial aerosol cans, but is refillable and reuseable with any number of substances found in the home or factory. Device 85 could be spaced forty feet or more away from the source of liquid and gas, i.e., bottle 86, and connected thereto by a hose or other conduit; this permits atomization at a point remote from the source of liquid and gas without appreciable loss of the atomizing power.

As an alternative, a self-contained aerosol system could be provided by eliminating compressor 89, making bottle 86 out of metal, and charging bottle 86 with butane or other appropriate gas forming substance.

Figure 8:
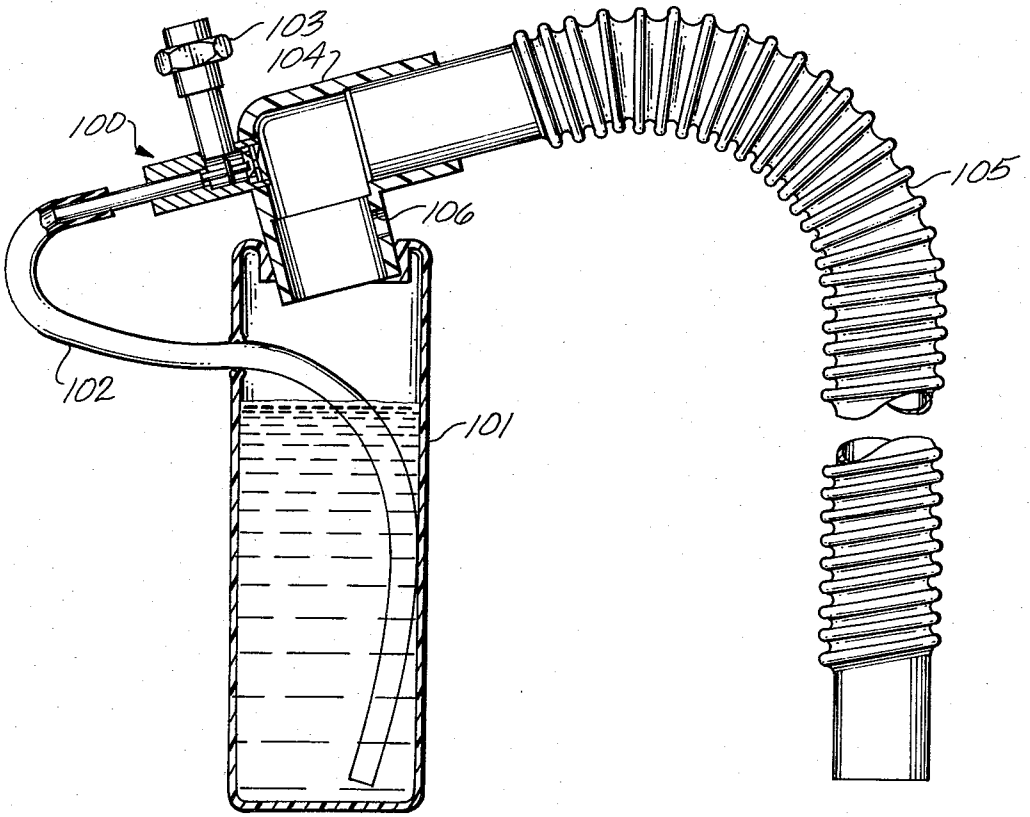
FIG. 8 is a side sectional view of a liquid vaporizing system incorporating the device of FIG. 1.

In FIG. 8, the device of FIG. 3, which is designated 100, is used in a vaporizer system. A bottle 101 holds a liquid to be vaporized. A flexible hose 102, which passes through the side wall of bottle 101 to the bottom thereof, supplies liquid to the interior of the hollow rod of device 100. The gas inlet has a fitting 103 for connection to an air compressor or source of compressed gas (not shown). An elbow fitting 104 is secured to the top of bottle 101 at an angle to the vertical so one end thereof opens into the interior of bottle 101. One end of a flexible spiral vapor delivery hose 105 is attached to the other end of elbow fitting 104. Device 100 is attached to the side of elbow fitting 104 so its outlet opens into elbow fitting 104 and faces toward hose 105. An air entrainment hole 106 is formed in the side of elbow fitting 104 near the end thereof opening into bottle 101.

In operation, air under pressure supplied to the inlet of device 100 generates a subatmospheric pressure that draws water into device 100 through tube 102. The air and atomized, essentially vaporized, water exit device 100 and flow through hose 105. By virtue of the enclosure around the outlet of device 100, a long region of subatmospheric pressure exists there, i.e., in elbow fitting 104 and part of hose 105. This region of subatmospheric pressure continues the atomization beyond the exit plane of device 100 due to additional "cold boiling" of the already finely atomized liquid. This subatmospheric pressure also optimally draws air in through hole 106 to entrain more air in the vaporized liquid for many applications such as medical, carburetor, or combustion, etc. The object of this system is to produce very simply and efficiently in "one pass" a very fine (1 to 5 micron mean diameter) vapor or fog. One feature of the invention is to condense in elbow fitting 104 and the connecting portion of hose 105 the larger droplets and have them return to bottle 101. Most other systems of this type cannot produce such a fine vapor or fog at low pressures and flow rates and on a once through basis. Excess water drawn into device 100 through hose 102 condenses in elbow fitting 104 and returns to bottle 101. Hole 106 could be throttled, i.e., its effective area could be changed, to control the gas to liquid ratio; such arrangement could have application in a carburetor of an internal combustion engine to change the air-fuel ratio as the engine operating conditions require.

Figure 9:
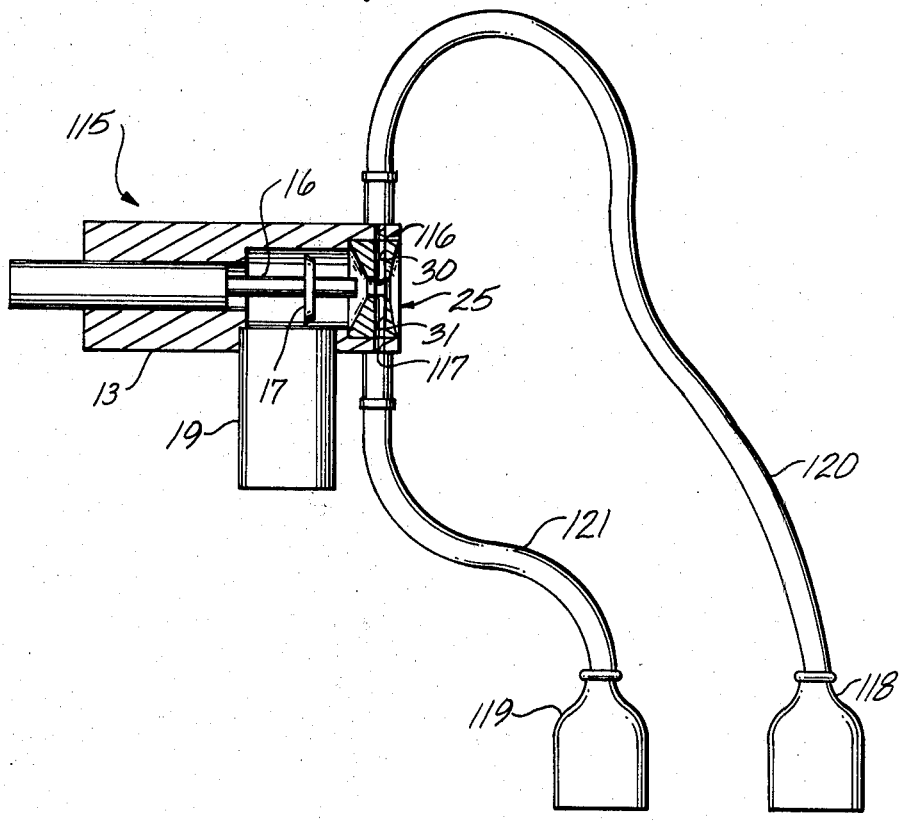
FIG. 9 is a side sectional view of an atomizing system incorporating a modified version of the device of FIG. 1.

In FIG. 9, a modified version of the device of FIG. 1, designated 115, is used in another atomizing system for producing a fan-shaped spray. Device 115 is identical to the device of FIG. 1 except for the addition of radial bores 116 and 117 in body member 13 and the elimination of bores 32 and 33, respectively, in insert 25. Bottles 118 and 119, which contain liquid to be atomized, are connected by hoses 120 and 121, respectively, to bores 116 and 117, respectively. Atomizing gas under pressure is supplied to inlet section 19. At any pressure the atomizing gas is sufficient to create a subatmospheric pressure at the restriction of insert 25, the liquid bottle 118 and 119 need not be pressurized, otherwise it could be pressurized. As an option, liquid to be atomized could also be additionally supplied through hollow rod 16 as in FIG. 1. Two or more fluids can thus be homogenized, chemically reacted, combusted, or mixed. Two or more entry ports can be made into the low pressure region of the restriction.

As previously mentioned, the stated dimensions of the devices disclosed herein are merely exemplary, providing the best known mode of operation of the invention. The stated dimensions can be scaled up or down in size to accomodate differing gas and liquid flow rates and pressures. In all cases, it is preferable, but not necessary, that the different cross-sectional areas in the flow passages are multiples of each other—for example, the first annulus, the second annulus, the outlet restriction, the auxiliary passages, where applicable, the inlet restriction, where applicable, and in the embodiment of FIGS. 5A and 5B the portion of the flow passage downstream of the rod.

The devices disclosed herein could be machined from metal or molded from plastic. The parts are designed to be easily interchangeable and cheaply produced. For example, plug 15, rod 16, and frustum 17 could be molded as a single part, inserts 25 and 55 could each be molded as a single part, inlet member 40 could be molded as a single part, and member 52 and rod 54 could be molded as a single part.

The described embodiments of the invention are only considered to be preferred and illustrative of the inventive concept; the scope of the invention is not to be restricted to such embodiments. Various and numerous other arrangements may be devised by one skilled in the art without departing from the spirit and scope of the invention. For example, in addition to atomization, the invention can be used in any number of fluid energizing and/or mixing operations for gas and/or liquid, and flow measurement and control. Although two diametrically opposed auxiliary passages as disclosed, is preferred, a single auxiliary passage or more than two may also provide some of the enumerated benefits of the auxiliary passages to some extent.

What is claimed is:

1. A vortex generating device comprising:

a flow passage having a cylindrical upstream section, a cylindrical downstream section, and a cylindrical intermediate section interconnected together and aligned with a flow axis, the downstream section forming an outlet restriction in the flow passage, the cross-sectional area of the intermediate section being substantially larger than that of the downstream section, and the cross section of the upstream section being larger than that of the intermediate section;

a rod aligned with the flow axis, the rod extending completely through the upstream section and through only part of the intermediate section; and an inlet opening into the upstream section, the inlet opening being aligned with an inlet axis at an angle to the flow axis.

2. The device of claim 1, in which the angle is 90°.

3. The device of claim 2, in which an inlet restriction is formed at the inlet.

4. The device of claim 3, additionally comprising a concave semispherical outlet section to which the intermediate section is coupled by the downstream section.

5. The device of claim 4, additionally comprising a source of atomizing gas under pressure and a source of liquid under pressure to be atomized, the liquid source and the gas source being connected to the inlet to cause the gas and the liquid to pass through the inlet together.

6. The device of claim 1, additionally comprising a source of gas under pressure connected to the inlet opening, the gas pressure being sufficiently large to cause the gas to pass through the inlet opening at sonic velocity.

7. A vortex generating device comprising:

a fluid inlet;

a fluid outlet opening into a region at ambient pressure;

a main flow passage having a flow axis, the main flow passage having aligned with the flow axis an upstream portion adjacent to the inlet and a downstream portion adjacent to the outlet;

a source of gas under pressure larger than the ambient pressure connected to the inlet to cause the gas to pass through the flow passage;

a restriction in the downstream portion;

at least one auxiliary flow passage connecting the upstream portion to the restriction; and means for generating in the upstream portion a plurality of tornado-like vortices in the gas arranged in a ring about the flow axis, the vortices rotating about the flow axis and flowing through the passages to meet at the restriction.

8. The device of claim 7, additionally comprising another auxiliary flow passage connecting the upstream portion to the restriction, the flow passages opening into the restriction from diametrically opposite directions.

9. The device of claim 8, in which the auxiliary flow passages open into the restriction from diametrically opposite directions transverse to the flow axis.

10. The device of claim 9, in which the auxiliary flow passages open into the upstream portion in directions parallel to the flow axis.

11. The device of claim 10, in which the restriction is a cylindrical section, additionally comprising a conical votrex collecting section coupling the upstream portion to the conical section, the auxiliary flow passages opening into the upstream portion through the conical vortex collecting section.

12. The device of claim 11, additionally comprising a concave semispherical outlet section to which the conical vortex collecting section is coupled by the cylindrical section.

13. The device of claim 12, in which the inlet is aligned with an inlet axis that intersects the flow axis at an angle.

14. The device of claim 13, in which the angle is 90°.

15. The device of claim 14, in which the generating means comprises a rod aligned with the flow axis.

16. The device of claim 15, in which the rod ends at the conical vortex collecting section.

17. The device of claim 15, in which the generating means additionally comprises a frustum mounted on the rod, the frustum having a base facing upstream.

18. The device of claim 17, in which the rod has a smaller cross-sectional area than the cylindrical section, extends through the flow passage beyond the semispherical outlet section, and is hollow, additionally comprising a source of liquid to be atomized connected to the hollow interior of the rod to deliver liquid from the source through the hollow rod beyond the semispherical outlet section.

19. The device of claim 17, in which the rod ends at the conical vortex collecting section.

20. The device of claim 9, in which the generating means comprises a rod aligned with the flow axis.

21. The device of claim 20, in which the inlet is aligned with an inlet axis that intersects the flow axis at an angle of 90°.

22. The device of claim 21, in which the end of the rod lies upstream of the restriction.

23. The device of claim 21, in which the end of the rod lies in the restriction.

24. The device of claim 21, in which the end of the rod lies downstream of the restriction.

25. The device of claim 21, in which the pressure of the gas from the source is sufficiently larger than the ambient pressure to cause the gas to pass through the inlet at sonic velocity.

26. The device of claim 7, in which the gas pressure is sufficiently larger than the ambient pressure to cause the gas to pass through the inlet at sonic velocity.

27. The device of claim 7, in which the generating means comprises a rod aligned with the flow axis, the rod having an end lying in the restriction.

28. The device of claim 27, in which the end of the rod lies partially in the path of the auxiliary passage.

29. The device of claim 7, in which the generating means comprises a rod aligned with the flow axis.

30. A vortex generating device comprising:

a fluid inlet;

a concave semispherical fluid outlet opening into a region at ambient pressure;

a flow passage between the inlet and the outlet, the flow passage having in alignment with a flow axis an upstream portion, a downstream portion, a cylindrical outlet restriction formed in the downstream portion, and a conical diverging section formed in the downstream portion between the cylindrical restriction and the semispherical outlet;

a source of gas under pressure larger than the ambient pressure connected to the inlet to cause the gas to pass through the flow passage; and means for generating a plurality of tornado-like vortices in the gas arranged in a ring about the flow axis, the vortices rotating about the flow axis.

31. The device of claim 30, additionally comprising a conical vortex collecting section in the downstream portion coupling the upstream portion to the cylindrical section.

32. The device of claim 31, in which the inlet is aligned with an inlet axis that intersects the flow axis at an angle.

33. The device of claim 32, in which the angle is 90°.

34. The device of claim 33, in which the generating means comprises a rod aligned with the flow axis.

35. The device of claim 34, in which the generating means additionally comprises a bluff body mounted on the rod in the upstream portion.

36. The device of claim 35, in which the buff body is a truncated frustum having a base that faces upstream.

37. The device of claim 30, in which the gas pressure is sufficiently larger than the ambient pressure to cause the gas to pass through the inlet at sonic velocity.

38. The device of claim 30, in which the flow passage additionally has aligned with the flow axis an upstream portion adjacent to the inlet, a downstream portion adjacent to the outlet, a restriction in the downstream portion and at least one auxiliary flow passage connecting the upstream portion to the restriction.

39. A vortex generating device comprising means defining a flow passage having an inlet, an outlet opening into a region at ambient pressure, a flow axis, and side walls aligned with the flow axis; a source of gas under pressure larger than the ambient pressure connected to the inlet to cause the gas to pass through the flow passage; means defining in the flow passage in alignment with the flow axis a first annulus having first given dimensions, the means defining a first annulus comprising an upstream portion of the side walls and a rod in alignment with the flow axis, the rod having an end lying in the flow passage; means defining in the flow passage in alignment with the flow axis and spaced downstream from the first annulus a second annulus having second given dimensions; means defining in the flow passage in alignment with the flow axis a restriction between the means defining a second annulus and the outlet, the first and second given dimensions being selected so the first and second annulae generate a plurality of tornado-like vortices in the gas, the vortices being arranged in a ring about the flow axis and rotating about the flow axis;

characterized in that the end of the rod lies in the means for defining a restriction.

40. The device of claim 39, in which the outlet is aligned with the flow axis and the inlet is aligned with an inlet axis that intersects the flow axis at an angle.

41. The device of claim 40, additionally comprising a source of atomizing gas under pressure and a source of liquid under pressure to be atomized, the liquid source and the gas source being connected to the inlet to cause the gas and the liquid to pass through the inlet together.

42. The device of claim 39, additionally comprising a source of gas under pressure connected to the inlet, the gas pressure being sufficiently larger than the ambient pressure to cause the gas to pass through the inlet at sonic velocity.

43. The device of claim 39, in which the means for defining a second annulus comprises the side walls and a bluff body mounted on the rod downstream from the first annulus.

44. The device of claim 39, in which an inlet restriction is formed at the inlet.

45. The device of claim 39, in which the second annulus has a cross section that becomes gradually smaller moving in a downstream direction.

46. The device of claim 39, in which the upstream portion of the side walls is cylindrical.

47. The device of claim 46, in which the means defining a second annulus comprises a downstream portion of the side walls that is cylindrical and a bluff body mounted on the rod, the upstream and downstream portions being equal in diameter.

48. The device of claim 46, in which the means defining a second annulus comprises a downstream portion of the side walls that is cylindrical and the rod, the downstream portion being smaller in diameter than the upstream portion.

49. The device of claim 46, in which the means defining a second annulus comprises a downstream portion of the side walls that is conical and the rod.

50. The device of claim 39, additionally comprising at least one auxiliary flow passage connecting the means defining a second annulus to the means defining a restriction.

51. The device of claim 39, additionally comprising a source of liquid under pressure to be atmoized, the liquid source being connected to the inlet to cause the gas and the liquid to pass through the inlet together.

52. The device of claim 39, additionally comprising a source of liquid under pressure to be atomized and means for delivering liquid from the source to the end of the rod.

53. A vortex generating device comprising:

a flow passage having a cylindrical upstream section, a cylindrical downstream section, and an outlet restriction aligned with a flow axis, the cross-sectional area of the downstream section being smaller than that of the upstream section;

a rod aligned with the flow axis, the rod extending completely through the upstream section and through only part of the downstream section such that the end of the rod lies in the downstream section;

an inlet opening into the upstream section, the inlet opening being aligned with an inlet axis at an angle to the flow axis; and a source of gas under pressure connected to the inlet opening, the gas pressure being sufficiently large to cause the gas to pass through the inlet at sonic velocity.

54. The device of claim 53, in which the gas pressure is sufficiently larger than the ambient pressure to cause the gas to pass through the inlet at sonic velocity.

55. The device of claim 53, additionally comprising a source of liquid to be atomized and means for delivering the liquid to the end of the rod.

* * * * *

UNITED STATES PATENT AND TRADEMARK OFFICE

CERTIFICATE OF CORRECTION

PATENT NO. : 4,241,877
DATED : December 30, 1980

INVENTOR(S) : Nathaniel Hughes

It is certified that error appears in the above-identified patent and that said Letters Patent are hereby corrected as shown below:

Col. 3, line 19, "19" should read --29--.

Col 4, line 29, "thse" should read --these--;

Col 5, line 34, "base" should read --bore--.

Col 6, line 54, "donwstream" should read --downstream--.

Col 7, line 15 "ration" should read --ratio--;
line 19 "sligthly" should read --slightly--.

Col 8, line 47, "dimeter" should read --diameter--.

Col 10, line 12, "bottle" should read --in bottles--.

Col 11, line 55, "votrex" should read --vortex--.

Col 13, line 4, "buff" should read --bluff--.

Signed and Sealed this

*Twenty-seventh* Day of *July 1982*

[SEAL]

*Attest:*

GERALD J. MOSSINGHOFF

*Attesting Officer*

*Commissioner of Patents and Trademarks*